US010072889B2

(12) United States Patent
Lissianski et al.

(10) Patent No.: US 10,072,889 B2
(45) Date of Patent: Sep. 11, 2018

(54) LIQUEFACTION SYSTEM USING A TURBOEXPANDER

(71) Applicant: GENERAL ELECTRIC COMPANY, Schenectady, NY (US)

(72) Inventors: Vitali Victor Lissianski, Schenectady, NY (US); Douglas Carl Hofer, Clifton Park, NY (US); Roger Allen Shisler, Ballston Spa, NY (US); Nikolett Sipoecz, Munich (DE); Xianyun Bi, Beijing (CN)

(73) Assignee: General Electric Company, Schenectady, NY (US)

( * ) Notice: Subject to any disclaimer, the term of this patent is extended or adjusted under 35 U.S.C. 154(b) by 261 days.

(21) Appl. No.: 14/749,390

(22) Filed: Jun. 24, 2015

(65) Prior Publication Data

US 2016/0377340 A1 Dec. 29, 2016

(51) Int. Cl.

| | |
|---|---|
| ***F25J 1/00*** | (2006.01) |
| ***F01D 15/00*** | (2006.01) |
| ***F25J 1/02*** | (2006.01) |

(52) U.S. Cl.

CPC ..... *F25J 1/0022* (2013.01); *F01D 15/005* (2013.01); *F25J 1/004* (2013.01); *F25J 1/0035* (2013.01); *F25J 1/0037* (2013.01); *F25J 1/0042* (2013.01); *F25J 1/0052* (2013.01); *F25J 1/0087* (2013.01); *F25J 1/021* (2013.01); *F25J 1/0208* (2013.01); *F25J 1/0257* (2013.01); *F25J 1/0283* (2013.01); *F25J 2220/64* (2013.01);

(Continued)

(58) Field of Classification Search

CPC ..... F25J 1/0022; F25J 1/004; F25J 1/0045; F25J 1/0257; F25J 2245/02; F25J 2220/64

See application file for complete search history.

(56) References Cited

U.S. PATENT DOCUMENTS 3,785,128 A * 1/1974 Redemann ..... F01D 15/005 415/169.2
4,014,674 A * 3/1977 Kirillov ..... F01D 25/32 55/442

(Continued)

FOREIGN PATENT DOCUMENTS

CH 521514 A 4/1972
CN 102620524 A 8/2012

(Continued)

OTHER PUBLICATIONS

PCT Invitation to Pay Additional Fees issued in connection with corresponding PCT Application No. PCT/US16/38565 on Oct. 18, 2016.

(Continued)

*Primary Examiner* — Brian King

(74) *Attorney, Agent, or Firm* — GE Global Patent Operation; Marc A. Vivenzio

(57) ABSTRACT

The subject matter disclosed herein relates to a liquefaction system. Specifically, the present disclosure relates to systems and methods for condensing a pressurized gaseous working fluid, such as natural gas, using at least one turboexpander in combination with other cooling devices and techniques. In one embodiment, a turboexpander may be used in combination with a heat exchanger using vapor compression refrigeration to condense natural gas.

15 Claims, 6 Drawing Sheets

(52) U.S. Cl.
CPC ..... *F25J 2230/08* (2013.01); *F25J 2230/30* (2013.01); *F25J 2240/02* (2013.01); *F25J 2240/04* (2013.01); *F25J 2240/30* (2013.01); *F25J 2240/40* (2013.01); *F25J 2245/02* (2013.01)

(56) References Cited

U.S. PATENT DOCUMENTS

| | | | | |
|---|---|---|---|---|
| 4,970,867 | A | 11/1990 | Herron et al. | |
| 5,359,856 | A | 11/1994 | Rhoades et al. | |
| 5,537,827 | A | 7/1996 | Low et al. | |
| 5,718,126 | A | 2/1998 | Capron et al. | |
| 5,755,114 | A | 5/1998 | Foglietta | |
| 6,116,027 | A * | 9/2000 | Smith | F02C 6/10 60/648 |
| 6,378,330 | B1 | 4/2002 | Minta et al. | |
| 6,564,578 | B1 | 5/2003 | Fischer-Calderon | |
| 6,694,774 | B1 * | 2/2004 | Rashad | F25J 1/0005 62/611 |
| 7,673,476 | B2 | 3/2010 | Whitesell | |
| 8,020,406 | B2 | 9/2011 | Vandor et al. | |
| 8,505,333 | B2 | 8/2013 | Evans et al. | |
| 2009/0064713 | A1 * | 3/2009 | Buijs | F25J 1/0022 62/613 |
| 2009/0205365 | A1 * | 8/2009 | Van Aken | F25J 1/0022 62/611 |
| 2009/0229275 | A1 | 9/2009 | Madison | |
| 2010/0186445 | A1 * | 7/2010 | Minta | F25J 1/0022 62/606 |
| 2011/0094262 | A1 * | 4/2011 | Turner | F25J 1/0022 62/613 |
| 2013/0125580 | A1 | 5/2013 | Hofer | |
| 2013/0239608 | A1 | 9/2013 | Lissianski et al. | |
| 2015/0033792 | A1 | 2/2015 | Lissianski et al. | |
| 2015/0204603 | A1 * | 7/2015 | Sheng | F25J 1/0022 62/614 |

FOREIGN PATENT DOCUMENTS

| | | | | |
|---|---|---|---|---|
| JP | 05223443 | A | 8/1993 | |
| JP | 05248761 | A | 9/1993 | |
| WO | 0188447 | A1 | 11/2001 | |
| WO | 2011135335 | A2 | 11/2011 | |
| WO | WO 2014166925 | A2 * | 10/2014 | F25J 3/061 |

OTHER PUBLICATIONS

PCT Search Report and Written Opinion issued in connection with corresponding PCT Application No. PCT/US16/38565 dated Feb. 1, 2017.

Nipen M et al., "Inherent Safety Analysis of Propane Pre-cooled Dual Independent Expander Process for LNG", Chemeca 2008, 1470-1479, 2008.

* cited by examiner

LIQUEFACTION SYSTEM USING A TURBOEXPANDER

BACKGROUND

The subject matter disclosed herein relates to a liquefaction system. Specifically, the present disclosure relates to systems and methods for generating liquefied natural gas using one or more turboexpanders.

Natural gas, when isolated from natural sources (e.g., underground in naturally occurring reservoirs), generally includes a mixture of hydrocarbons. The major constituent in these hydrocarbons is methane, which is generally referred to as natural gas in commerce. Natural gas is useful as a source of energy because, among other things, it is highly combustible. One particularly desirable characteristic of natural gas is that it is generally considered to be one of the cleanest hydrocarbons for combustion. Because of this, natural gas is often used as fuel in a wide variety of settings, including heaters in residential homes, gas stoves and ovens, dryers, water heaters, incinerators, glass melting systems, food processing plants, industrial boilers, electrical generators among numerous others. Generally, natural gas (e.g., untreated or raw natural gas) removed from reservoirs is processed and cleaned prior to entering pipelines that eventually feed the gas to homes and industrial plants. For example, natural gas may be processed to remove oil and condensates, water, sulfur, and carbon dioxide. During these processes, natural gas may be liquefied, which may facilitate separation (e.g., purification) and transport.

Natural gas may be transferred to various destinations via pipelines or, in certain situations, via storage vessels. Unfortunately, pipeline networks can represent a significant investment, and are generally used only in situations where the natural gas is traveling a relatively short distance. When natural gas is extracted far from its final destination, transportation by way of storage vessels may be more economical. Indeed, as oil and coal resources become scarcer, the demand for liquefied natural gas has increased because of its ability to be transported to destinations that do not have access to a pipeline.

In these situations, the natural gas may be liquefied, transported in a vessel that will keep the gas at cryogenic temperatures, and re-vaporized upon arrival at its destination. Natural gas condenses to its liquid state at atmospheric pressure at about −260° F., or approximately −162° C. Accordingly, it should be appreciated that reaching such a low temperature on a large scale, while also maintaining these temperatures during transport, can be challenging. For example, traditional refrigeration techniques may be sufficient to reach or maintain these temperatures. However, these techniques can often involve significant capital investment, such as in refrigerant, compressors, and so forth. Therefore, typical approaches to liquefying natural gas may be subject to further improvement.

BRIEF DESCRIPTION

In one embodiment, a gas feed liquefaction system includes a flow path configured to convey a working fluid having a vapor in a downstream direction and an initial cooling phase in a first heat exchange relationship with the flow path, where the initial cooling phase includes a heat exchanger. The gas feed liquefaction system also includes a compressor positioned downstream of the initial cooling phase and a second cooling phase in a second heat exchange relationship with the flow path, where the second cooling phase is downstream from the compressor and has a first turboexpander and a second turboexpander, and where the first and second turboexpanders are configured to condense at least a first portion of the vapor into a liquid. The gas liquefaction system further includes a separation vessel downstream of the second turboexpander and configured to separate a second portion of the vapor from the liquid and a recycle stream configured to direct the second portion of the vapor through the heat exchanger toward a mixer, where the mixer is configured to combine the second portion of the vapor with the flow path upstream of the second cooling phase.

In another embodiment, a gas feed liquefaction system includes a flow path configured to convey a working fluid having a vapor in a downstream direction and an initial cooling phase in a first heat exchange relationship with the flow path, where the initial cooling phase comprises a heat exchanger. The gas liquefaction system also includes a compressor positioned downstream of the initial cooling phase and a second cooling phase in a second heat exchange relationship with the flow path, where the second cooling phase is downstream from the compressor and has a first turboexpander and a second turboexpander, and where the first and second turboexpanders are configured to condense at least a first portion of the vapor into a liquid. The gas liquefaction system further includes a splitter positioned downstream of the first turboexpander and upstream of the second turboexpander, where the splitter directs a first stream of the flow path through the heat exchanger and a second stream of the flow path to the second turboexpander, a separation vessel downstream of the second turboexpander and configured to separate a second portion of the vapor from the liquid, and a recycle stream configured to direct the second portion through the heat exchanger to a mixer, wherein the mixer is configured to combine one or more of the first stream, the second portion, and the flow path upstream of the second cooling phase.

In another embodiment, a method includes cooling a fluid along a fluid path using a heat exchanger of an initial cooling phase, compressing the fluid along the fluid path, and cooling the fluid along the fluid path using at least one turboexpander of a second cooling phase, wherein the at least one turboexpander is configured to expand the fluid such that a temperature and pressure of the fluid are reduced to generate a fluid stream having both a vapor phase and a liquid phase. The method also includes separating the vapor phase from the liquid phase using a separator and combining the vapor phase with the fluid upstream of the second cooling phase.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
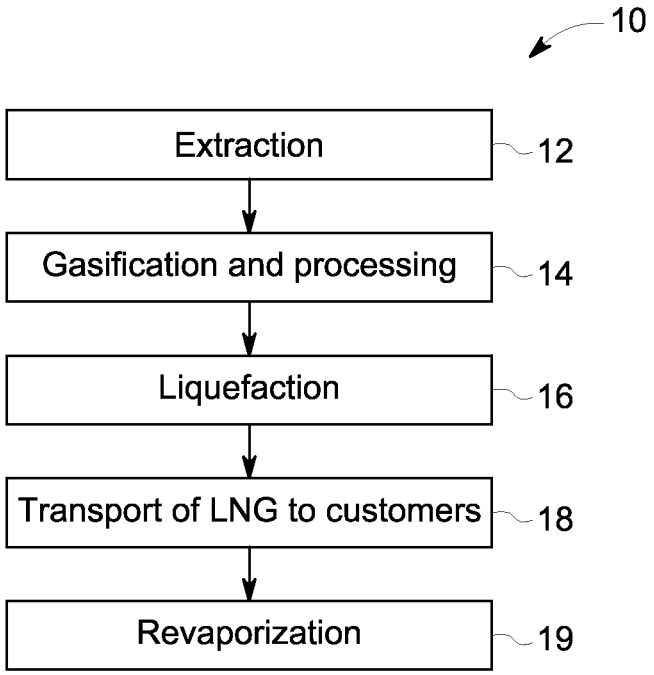
FIG. 1 is a block diagram of an embodiment for an overall process of making and utilizing a liquefied gas, in accordance with an aspect of the present disclosure.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements. Furthermore, any numerical examples in the following discussion are intended to be non-limiting, and thus additional numerical values, ranges, and percentages are within the scope of the disclosed embodiments.

Natural gas (NG) liquefaction plants may utilize a vapor compression refrigeration process to cool natural gas to its liquid state (e.g., from natural gas to liquefied natural gas (LNG)). These processes may include one or more compressors to compress and increase a pressure of a refrigerant, one or more condensers that may condense the refrigerant (e.g., using a cooling medium such as water or ambient air) to a liquid state, one or more expansion valves to further cool the refrigerant, and one or more heat exchangers (e.g., evaporators). Refrigerant from a vapor compression refrigeration process may be used to cool natural gas via the one or more heat exchangers. For example, heat from the natural gas may be transferred to the refrigerant in the heat exchanger, thereby lowering the temperature of the natural gas and re-vaporizing the refrigerant. Although heat exchangers are typically sufficient to liquefy natural gas, energy losses generally occur within a heat exchanger as a result of heat transfer to surfaces of the heat exchanger and/or to the ambient air. Accordingly, it is now recognized that using additional cooling devices to form LNG may result in lower energy requirements, and thus a higher efficiency, for the liquefaction process.

In accordance with present embodiments, one or more turboexpanders may be used in combination with, or in lieu of, a vapor compression refrigeration cycle to achieve a condensation temperature of natural gas. Further, it is now recognized that the integration of these cooling units may enable the liquefaction process to operate more efficiently, particularly when the supplied natural gas is at a relatively high pressure.

Turboexpanders may generate work via expansion of a pressurized (e.g., compressed) vapor (e.g., a working fluid). Therefore, a turboexpander may supply power to a load, such as a compressor or a generator, while simultaneously cooling (e.g., decreasing the temperature) the pressurized vapor. In some cases, as the temperature decreases, all or a portion of the vapor may condense into a liquid state. As the pressure difference between the vapor entering the turboexpander and the vapor/liquid mixture exiting the turboexpander increases, the more energy is extracted from the vapor. This increase in extracted energy may enable a liquid fraction of the vapor/liquid mixture to increase (e.g., more of the vapor is condensed in the turboexpander). Therefore, turboexpanders may be desirable when a supply of natural gas to a liquefaction plant is at a relatively high pressure (e.g., above 40 atmosphere) because the turboexpander may extract work from the natural gas while simultaneously taking advantage of the turboexpander's cooling ability.

Turboexpanders may include one or more stages. The number of stages in a turboexpander may dictate the pressure difference between the vapor entering the turboexpander and the vapor/liquid mixture exiting the turboexpander. In some instances, this pressure difference may be quantified as a ratio (e.g., the pressure of the vapor entering the turboexpander divided by the pressure of the vapor/liquid mixture exiting the turboexpander). In some embodiments of the present disclosure, the turboexpanders may include between 7 and 15 stages. In other embodiments, the turboexpanders may include less than 7 stages (e.g., 6, 5, 4, 3, 2, or 1) or more than 15 stages (e.g., 16, 17, 18, 19, 20, 25, 30, or more) to produce a suitable pressure difference or pressure ratio. In certain embodiments, the disclosed turboexpanders may produce a pressure ratio of between 0.5 and 10, between 1 and 5, or between 2 and 4.

Furthermore, embodiments of the present disclosure may include more than one turboexpander. For example, a working fluid (e.g., natural gas) may be configured to flow through a first turboexpander and a second turboexpander in succession (e.g., a series arrangement). In other embodiments, the working fluid may be split such that a portion of the working fluid flows through a first turboexpander and a second portion of the working fluid flows though a second turboexpander (e.g., a parallel arrangement). In still further embodiments, the liquefaction process may include more than two turboexpanders (e.g., 3, 4, 5, 6, 7, 8, 9, 10, or more) in a series configuration, in a parallel configuration, or in some combination of series and parallel arrangements. In yet another embodiment, a portion of the working fluid may be withdrawn from a turboexpander stage and used (e.g., recycled) as a refrigerant in other areas of the process, while the rest of the working fluid flows through any remaining stages.

As set forth above, in certain embodiments, turboexpanders may be positioned downstream from one or more vapor compression refrigeration cycles to provide supplemental cooling to a working fluid. For example, the one or more vapor compression refrigeration cycles may pre-cool natural gas to a temperature just above a condensation temperature of the natural gas. The turboexpanders may then extract work from the vaporous natural gas while simultaneously condensing all or a portion of the natural gas to LNG via expansion, thereby increasing efficiency. Turning to the figures, FIG. 1 depicts a process flow diagram of an embodiment of an overall process 10, which includes a number of stages to isolate and use liquefied natural gas. The process 10 includes extraction of the natural gas at block 12, where natural gas may be extracted from underground reservoirs using, as an example, drilling techniques, fracturing, and so forth. The extracted natural gas may be stored above ground, and/or may be provided (e.g., via a pipeline) to a gasification processing stage at block 14. By way of example, in the gasification processing stage, the natural gas may enter a processing device to remove certain substances, such as water, carbon dioxide, and sulfur (e.g., via molecular sieves). Removal of these components may enable the gas to burn more efficiently and cleanly.

After the natural gas undergoes the gasification processing stage at block 14, or simultaneously during block 14, the natural gas may undergo liquefaction at block 16. At block 16, the natural gas may be cooled to a temperature of −162° C., where it condenses to a liquid state. In accordance with present embodiments, the natural gas may be cooled by a system including both vapor compression refrigeration and one or more turboexpanders.

Because of its decreased volume and relatively high cost associated with pipeline transport, the liquid natural gas may be more desirable to transport compared to gaseous natural gas. Accordingly, in some embodiments, the liquid natural gas may undergo transportation at block 18, which may include transporting the liquid natural gas to customers in transportation vessels that keep the liquefied natural gas at the cryogenic temperatures necessary for the liquefied natural gas to remain in a liquid state. Finally, upon reaching its destination, the liquefied natural gas may undergo re-vaporization at block 20, where the natural gas is converted back into a gaseous state. In its gaseous state, the natural gas may be used as an energy source (e.g., via combustion).

Figure 2:
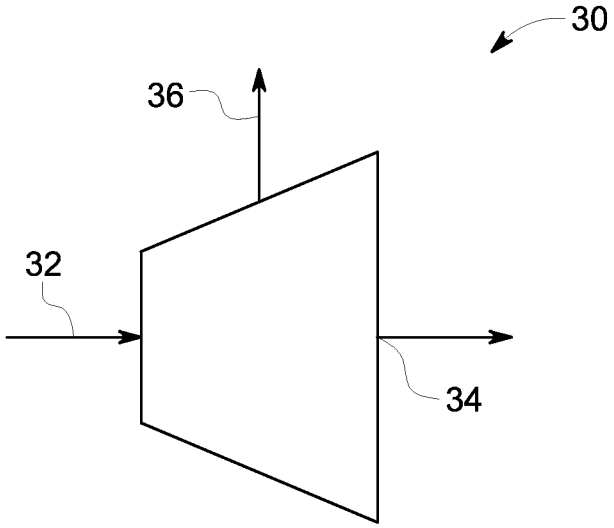
FIG. 2 is a simplified block diagram of a turboexpander to be used with a gas liquefaction system, in accordance with an aspect of the present disclosure.
Figure 3:
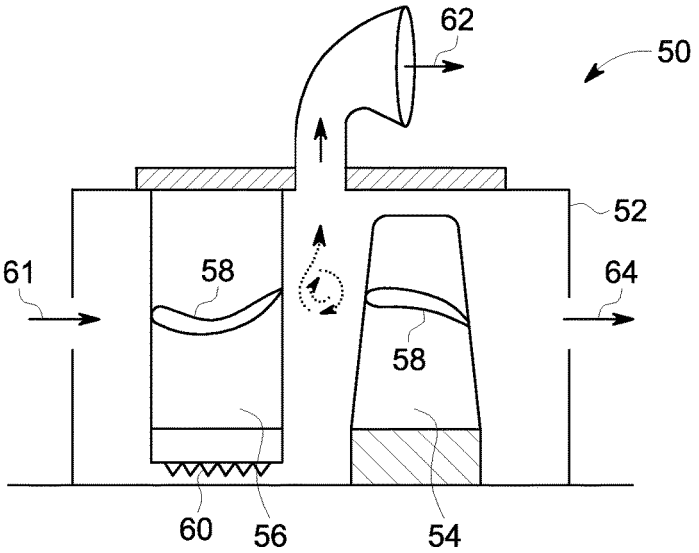
FIG. 3 is a cross-sectional view of a single-phase turboexpander to be used with a gas liquefaction system, in accordance with an aspect of the present disclosure.
Figure 4:
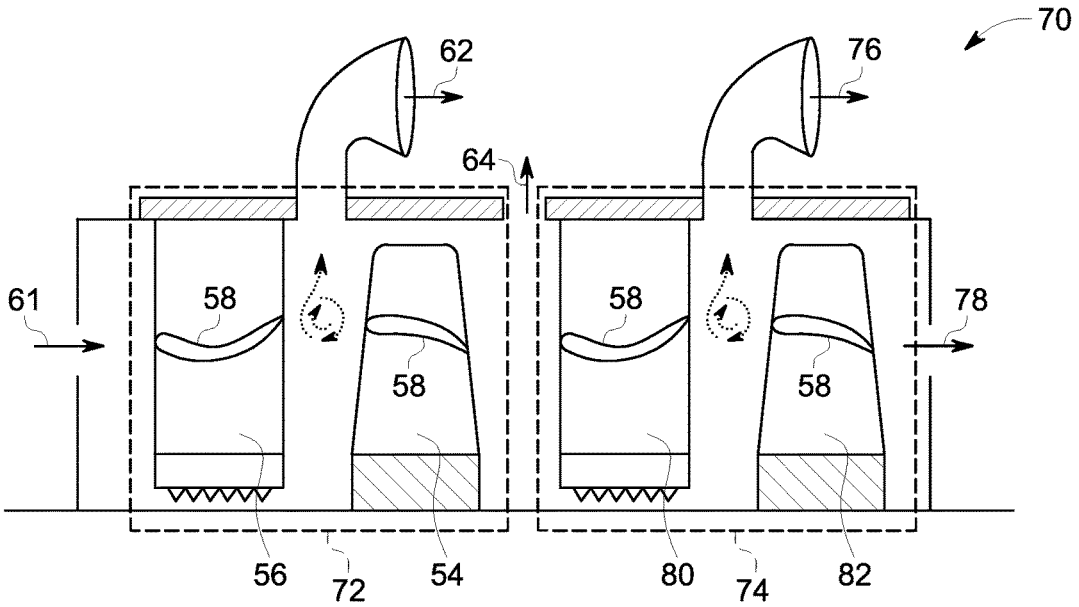
FIG. 4 is a cross-sectional view of a multi-phase turboexpander to be used with a gas liquefaction system, in accordance with an aspect of the present disclosure.

As discussed above, one or more turboexpanders may be utilized to condense a working fluid (e.g., natural gas) to a liquid state. FIG. 2 illustrates a simplified block diagram of a turboexpander 30 that may be utilized in a process to liquefy the working fluid. Although in certain embodiments, the turboexpander 30 may include a single stage (e.g., as shown in FIG. 3), the turboexpander may also include multiple stages (e.g., as shown in FIG. 4). The turboexpander 30 may include an inlet 32 for the working fluid as well as an outlet 34. The inlet 32 receives the working fluid (e.g., natural gas in a vaporous state) and the outlet 34 may direct the working fluid (e.g., a mixture of natural gas in a vaporous state and LNG) to additional cooling devices. In certain embodiments, the turboexpander 30 may include a second outlet 36 and may also act as a separator. For example, the turboexpander 30 may separate the vaporous working fluid from any condensed working fluid (e.g., LNG) formed as a result of the expansion process. Therefore, vaporous natural gas may exit the turboexpander 30 from outlet 36 and be directed toward a recycle flow path so that it may eventually be returned to the turboexpander 30 and condensed into LNG. Additionally, the LNG formed in the turboexpander 30, or a mixture of vapor and LNG, may exit from outlet 34 and be directed downstream for further processing and/or transportation. In other embodiments, the LNG may exit the turboexpander 30 from the outlet 36, and subsequently be separated from any vaporous working fluid. The separated vaporous working fluid may then undergo additional expansion and cooling to form more LNG.

FIG. 3 illustrates a cross-sectional view of a single stage turboexpander 50. As shown in the illustrated embodiment, the turboexpander 50 includes a housing 52 that includes several components that operate to expand the working fluid (e.g., natural gas). For example, the turboexpander 50 may have a rotating component 54 (e.g., a rotor) as well as a stationary component 56 (e.g., a stator or a nozzle) disposed in the housing 52. The turboexpander 50 may also include one or more blades 58 configured to direct the working fluid through the turboexpander 50, while simultaneously converting the pressure drop of the working fluid to work that may ultimately power a load (e.g., a compressor). Additionally, the turboexpander 50 may include a seal 60 to prevent or minimize leakage of the working fluid.

As shown in the illustrated embodiment, the turboexpander 50 may include an inlet 61, a first outlet 62, and a second outlet 64. In certain embodiments, the working fluid (e.g., natural gas) may be directed to enter the turboexpander 50 in a vapor state through the inlet 61. As the working fluid expands, a temperature of the working fluid decreases, thereby causing at least a portion of the working fluid to condense to a liquid form. The working fluid that remains in a vapor state may be directed to exit the turboexpander 50 via the first outlet 62, whereas the working fluid that condenses to a liquid state may exit the turboexpander 50 via the second outlet 64. In certain embodiments, the working fluid exiting the turboexpander 50 through the second outlet 64 may be a mixture of vapor and liquid.

Similarly, FIG. 4 illustrates a cross-sectional view of a turboexpander 70 having a first phase 72 and a second phase 74. It should be noted that while the turboexpander 70 is illustrated as having two phases, the turboexpander may include more than two phases (e.g., 3, 4, 5, 6, 7, 8, 9, 10, or more phases). For example, the turboexpander 70 may include between 7 and 15 phases, or between 9 and 12 phases.

As shown in the illustrated embodiment of FIG. 4, the turboexpander 70 may include the inlet 61, the first outlet 62, the second outlet 64, a third outlet 76, and/or a fourth outlet 78. Additionally, the turboexpander may include the stationary component 56, a second stationary component 80, the rotating component 54, a second rotating component 82, and the blades 58. Again, the working fluid may enter the turboexpander 70 through the inlet 61. The working fluid may be directed through the first phase 72, where a pressure of the working fluid drops (e.g., from a first pressure to a second pressure, less than the first pressure). Accordingly, a temperature of the working fluid may also decrease as a result of the pressure drop causing some or all of the working fluid to condense from a vapor state to a liquid state. In certain embodiments, a portion of the working fluid in the vapor state may exit the turboexpander 70 through the first outlet 62. In certain embodiments, vaporous working fluid exiting the first outlet 62 may be recycled with working fluid upstream of the turboexpander 70. Further, the vaporous working fluid directed through the first outlet 62 may be in a heat exchange relationship with working fluid upstream of the turboexpander 70 to pre-cool the working fluid that enters the turboexpander 70. Such a heat exchange relationship will be described in more detail herein with reference to FIG. 5.

The remaining working fluid that does not exit through the first outlet 62 (e.g., a mixture of vapor and liquid) may continue through the turboexpander 70 to the second phase 74 or it may exit the turboexpander 70 via the second outlet 64 between the first phase 72 and the second phase 74. In certain embodiments, working fluid exiting the second outlet 64 may be recycled with working fluid upstream of the turboexpander 70. Further, the working fluid directed through the second outlet 64 may also be in a heat exchange relationship with working fluid upstream of the turboexpander 70 to pre-cool the working fluid that enters the turboexpander 70.

The working fluid may be directed through the second phase 74 by the second stationary component 80 and the second rotating component 82. Again, the pressure of the working fluid may drop (e.g., from the second pressure to a third pressure, less than the second pressure) and the temperature of the working fluid may also decrease. In certain embodiments, the working fluid that flows through the second phase 74 may contain a fraction of vaporous working fluid. Accordingly, some of the vaporous working fluid may condense as a result of the decreasing temperature. Any remaining vaporous working fluid may exit the turboexpander 70 through the third outlet 76. In certain embodiments, vaporous working fluid exiting through the third outlet 76 may be recycled with working fluid upstream of the turboexpander 70. Further, the vaporous working fluid directed through the third outlet 76 may be in a heat exchange relationship with working fluid upstream of the turboexpander 70 to pre-cool the working fluid that enters the turboexpander 70. Such a heat exchange relationship will be described in more detail herein with reference to FIG. 5. In other embodiments, the working fluid in the second phase 74 may contain no vapor, such that the liquid working fluid is further cooled to cryogenic temperatures. In any event, the working fluid that does not exit through the third outlet 76 may be directed through the fourth outlet 78, where it may be further processed (e.g., cooled by another turboexpander or other cooling device) or prepared for transportation.

Although the turboexpanders 30, 50, and/or 70 may be utilized to condense a vapor into a liquid state, the turboexpander 30, 50, and/or 70 may be one component of an overall process used to condense working fluid (e.g., natural gas) to a liquid state (e.g., LNG).

Figure 5:
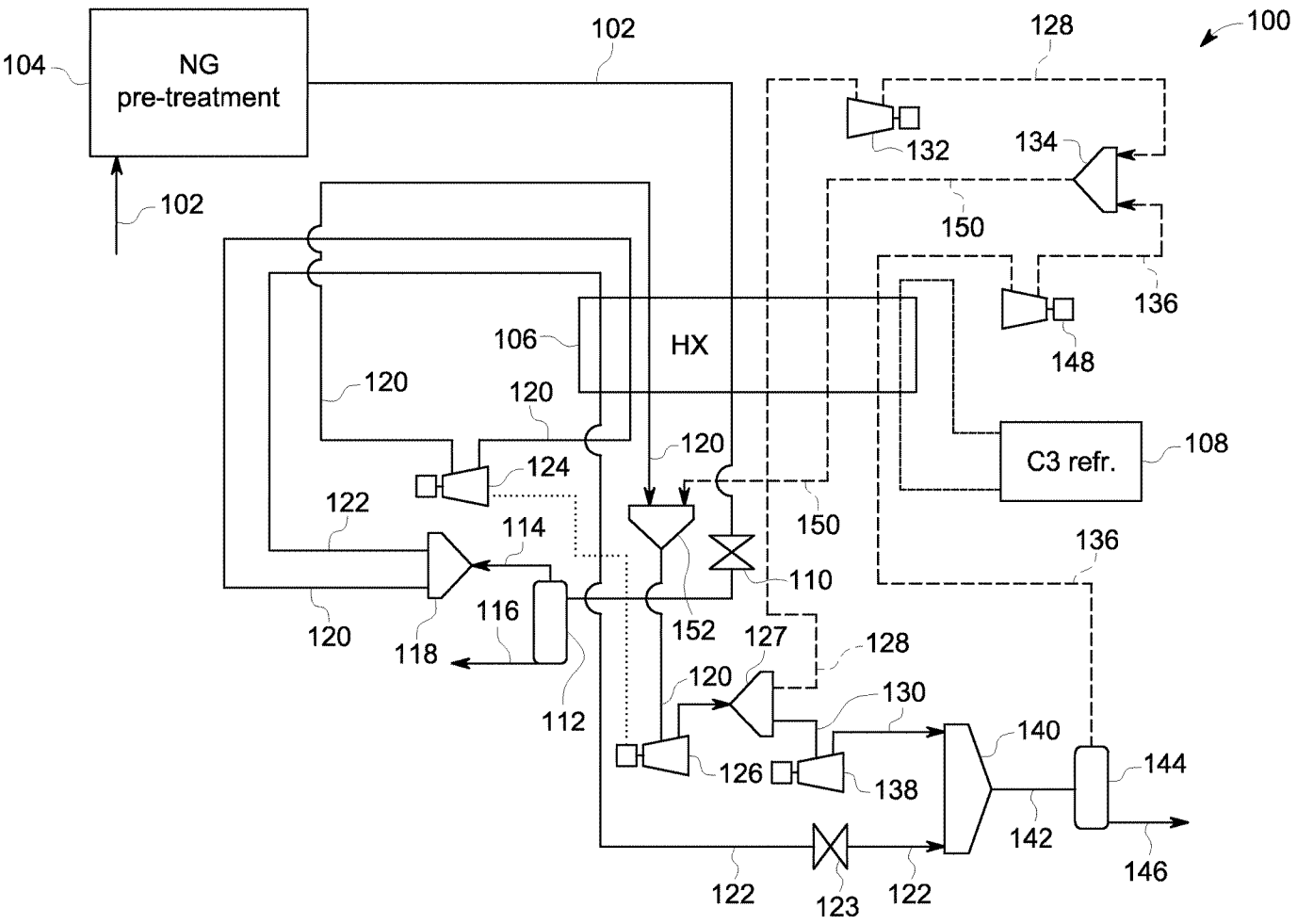
FIG. 5 is a process flow diagram of an embodiment of a gas liquefaction system that includes one or more turboexpanders configured to cool and condense natural gas to produce liquefied natural gas (LNG), in accordance with an aspect of the present disclosure.

FIG. 5 is an illustration of a process flow diagram of an overall process 100 that may be used to liquefy a working fluid (e.g., natural gas), in accordance with aspects of the present disclosure. For example, unprocessed or raw working fluid 102 (e.g., natural gas) may be directed to a pre-treatment process 104 where the working fluid 102 may undergo moisture removal or another form of pre-treatment prior to beginning liquefaction. Other forms of pre-treatment may include carbon dioxide ($CO_2$) and mercury (Hg) removal from the working fluid. In certain embodiments, the unprocessed or raw working fluid 102 may be pressurized (e.g., at a pressure above 40 atmosphere). Pressurized working fluid 102 may be liquefied more efficiently by utilizing one or more turboexpanders because a larger pressure drop may be established between the working fluid entering a turboexpander and the working fluid (e.g., a vapor/liquid mixture) exiting the turboexpander.

After the pretreatment process 104 the working fluid 102 may be directed towards a heat exchanger 106. The heat exchanger 106 may contain a variety of passages enabling multiple streams (e.g., the working fluid 102 or a recycle stream) to undergo heat transfer at any given moment. For example, the heat exchanger 106 may be configured to direct 1, 2, 3, 4, 5, 6, 7, 8, 9, 10, or more streams through various passages to undergo heat transfer. As the working fluid 102 passes through the heat exchanger, a temperature of the working fluid 102 (e.g., natural gas) may decrease. The heat exchanger 106 may be any suitable heat exchanger capable of enabling the transfer of thermal energy between passages, such as a shell and tube heat exchanger, plate heat exchanger, plate and shell heat exchanger, adiabatic wheel heat exchanger, plate fin heat exchanger, pillow plate heat exchanger, brazed aluminum heat exchanger, and the like.

However, as described above, using a heat exchanger to condense all the working fluid 102 may result in energy losses in the heat exchanger, thus increasing energy requirements to liquefy the working fluid, and decreasing efficiency. Therefore, some liquefaction of the working fluid may occur in a turboexpander that serves as an additional cooling device. For example, the heat exchanger 106 may cool the working fluid to a temperature just above a condensation temperature of the working fluid. The turboexpander may then extract work through expansion of the cooled, vaporous working fluid, while simultaneously condensing the working fluid, thereby enhancing efficiency of the liquefaction process.

After making a first pass through the heat exchanger 106, heavy hydrocarbons (e.g., substances containing more than two carbon atoms) in the working fluid 102 may partially condense. Heavy hydrocarbons may be removed prior to liquefaction to prevent any formation of solids that may plug the equipment. As shown in the illustrated embodiment, the separation of heavy hydrocarbons from natural gas may take place in a separator 112. However, a pressure of the working fluid maybe reduced upstream of the separator 112 using an expansion valve 110. In certain embodiments, the expansion valve 110 may decrease an amount of methane dissolved in heavy hydrocarbons, which may reduce methane losses during the separation process.

The working fluid 102 may then enter the separator 112 after exiting the expansion valve 110. The separator 112 may split the working fluid 102 into a decontaminated stream 114 and a heavy hydrocarbons and/or contaminants stream 116. The decontaminated stream 114 may then enter a splitter 118 that again splits the decontaminated stream 114 into a primary cold stream 120 and a bypass stream 122. The bypass stream 122 again flows through the heat exchanger 106, where a temperature of the bypass stream 122 may decrease. However, the bypass stream 122 may not be directed through any turboexpanders. Rather, the bypass stream 122 may again pass through the heat exchanger 106 and subsequently undergo expansion in a second expansion valve 123. Both the heat exchanger 106 and the second expansion valve 123 may enable a temperature of the bypass stream 122 to decrease. In certain embodiments, the bypass stream 122 is the working fluid 102 already in liquid form (e.g., LNG) after exiting the heat exchanger 106. Therefore, to enhance efficiency of the process, the bypass stream 122 may not be directed through any turboexpanders. Rather, the bypass stream 122 may be directed further downstream where it may be prepared for transportation.

Figure 7:
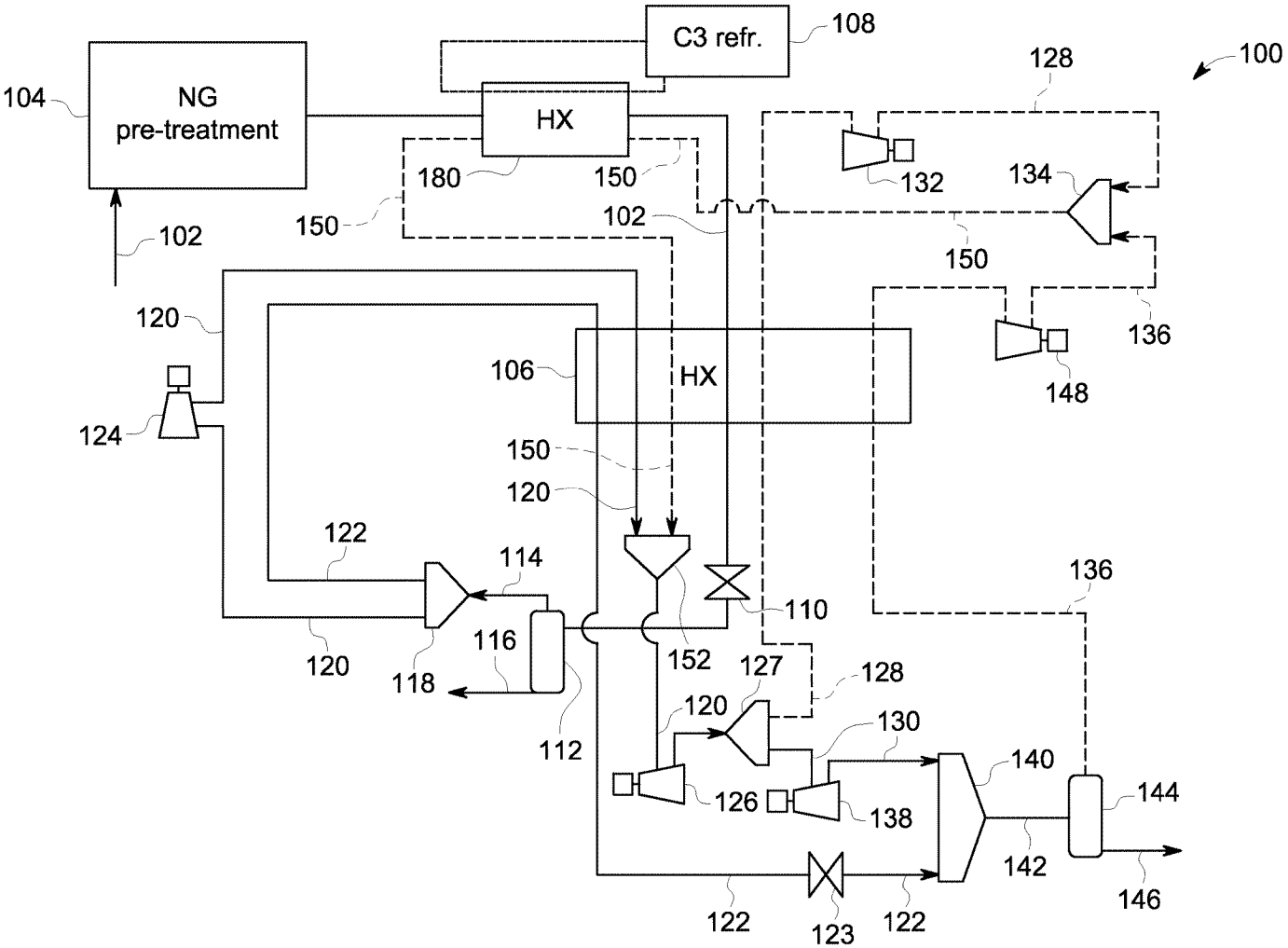
FIG. 7 is a process flow diagram of the gas liquefaction system of FIGS. 5 and 6 having fewer streams pass through a heat exchanger, in accordance with an aspect of the present disclosure.

Conversely, the primary cold stream 120 may contain substantially vaporous working fluid. Therefore, the primary, cold working fluid stream 120 may be directed through a compression and an expansion process to further cool the primary cold stream 120 to a temperature just above a condensation temperature of the fluid, for example. Accordingly, the primary cold stream 120 may be redirected through the heat exchanger 106 where it may be used as a refrigerant. As a result, the primary cold stream 120 temperature may increase prior to entering a compressor 124. In other embodiments, the primary cold stream 120 may be directed toward the compressor 124 and bypass the heat exchanger 106 altogether (e.g., as shown in FIG. 7). The compressor 124 may cause the working fluid in the primary cold stream 120 to increase in pressure (e.g., to above 40 atmosphere). Increasing the pressure of the working fluid in the primary cold stream 120 may enable a larger pressure drop in a turboexpander, thereby enhancing an efficiency of the overall process 100 (e.g., as a result of more work being extracted in the turboexpander). After compression in the compressor 124, the primary cold stream 120 may again flow through the heat exchanger 106 where the temperature of the primary cold stream 120 may decrease (e.g., to a temperature just above the condensation temperature of the fluid). Directing the primary cold stream 120 through the heat exchanger 106 after compression may be desirable because the primary cold stream 120 may incur an increase in temperature as a result of compression. Therefore, the efficiency of the process 100 may be enhanced by pre-cooling the primary cold stream 120 before directing the primary cold stream 120 to a first turboexpander 126.

The primary cold stream 120 may then be directed to one or more turboexpanders. As shown in the illustrated embodiment of FIG. 5, the primary cold stream 120 is directed to flow through the first turboexpander 126 where the working fluid may decrease in pressure and temperature. In certain embodiments, the turboexpander 126 may be mechanically coupled to the compressor 124 and configured to power the compressor 124 via work generated during expansion of the primary cold stream 120. In other embodiments, the turboexpander 126 may be connected to another load (e.g., a compressor of the vapor compression refrigeration cycle 108, a compressor along a recycle stream flow path, or another device that uses energy).

In certain embodiments, the primary cold stream 120 may then be directed toward a second splitter 127. The second splitter 127 may divide the primary cold stream 120 into a first recycle stream 128 and a secondary stream 130. The secondary stream 130 may include a mixture of vapor and liquid, whereas the first recycle stream 128 may include substantially vaporous working fluid. In certain embodiments, the first recycle stream 128 may be directed to the heat exchanger 106 where it is configured to absorb heat from the working fluid 102, the primary cold stream 120, and/or the bypass stream 122. Additionally, the first recycle stream 128 may be directed toward a second compressor 132 and a mixer 134, where it combines with a second recycle stream 136. In other embodiments, the working fluid in the first recycle stream 128 may include sufficient pressurization, such that the second compressor 132 may not be included in the process 100.

The secondary stream 130 may enter a second turboexpander 138 downstream from the splitter 127. The second turboexpander 138 may decrease a pressure of the working fluid in the secondary stream 130, thereby decreasing a temperature of the working fluid in the secondary stream 130 and causing some or all of the working fluid in the secondary stream 130 to condense to a liquid. In certain embodiments, the second turboexpander 138 may be connected to the compressor 124 and configured to power the compressor 124 via work created and captured during expansion of the primary cold stream 120. In other embodiments, the second turboexpander 138 may be connected to another load (e.g., a compressor of the vapor compression refrigeration cycle 108, a compressor along a recycle stream flow path, or another device that uses energy). Although the illustrated embodiment of FIG. 5 shows two turboexpanders 126 and 138 in a series configuration, it should be noted that the process 100 may include any suitable number of turboexpanders, in either a series or parallel arrangement, to condense the working fluid to its liquid state. For example, the process 100 may include a single turboexpander where the stream 128 is withdrawn from the turboexpander after undergoing a portion of stages in the turboexpander, while the stream 130 exits the turboexpander after undergoing all compression stages.

In certain embodiments, the secondary stream 130 is mixed with the bypass stream 122 in a second mixer 140 to form a mixed stream 142. The mixed stream 142 may then flow through a second separator 144 where any remaining vapor is separated from liquid working fluid 146 (e.g., LNG) to form the second recycle stream 136. The second recycle stream 136 may be directed through the heat exchanger 106 where it absorbs heat from the working fluid 102, the primary cold stream 120, and/or the bypass stream 122. The second recycle stream 136 may also be directed through a third compressor 148 and into the mixer 134 where it may be combined with the first recycle stream 128 to form a combined recycle stream 150. The combined recycle stream 150 may then be directed toward the heat exchanger 106 where it absorbs heat from the working fluid 102, the primary cold stream 120, and/or the bypass stream 122. The combined recycle stream 150 may also flow toward a third mixer 152 to combine with the primary cold stream 120 upstream of the first turboexpander 126. It should be noted that while the illustrated embodiments shows the first recycle stream 128 and the second recycle stream 136 being mixed to form the combined recycle stream 150, the first recycle stream 128 and/or the second recycle stream 136 may be mixed with the primary cold stream 120 and/or the working fluid 102 at any location upstream of the first turboexpander 126.

As discussed previously, the heat exchanger 106 utilizes the primary stream 120, the first recycle stream 128, and the second recycle stream 136 as coolants that may be configured to absorb heat from the working fluid 102, the bypass stream 122, and/or the combined recycle stream 150. Additionally, the heat exchanger 106 may also be configured to utilize a refrigerant of the vapor compression refrigeration cycle 108 as an additional coolant for the working fluid 102, the primary cold stream 120, and/or the bypass stream 122.

A vapor compression refrigeration cycle generally includes a compressor, a condenser, an evaporator, and an expansion device. The refrigerant enters the compressor as a vapor and is compressed to increase a pressure of the refrigerant. As a result of compression, the refrigerant increases in temperature. Therefore, the refrigerant may be directed toward a condenser to decrease the temperature of the refrigerant. The refrigerant then may enter an expansion device where a pressure of the refrigerant decreases and the temperature also decreases. The refrigerant is now cool and may be absorb heat from another fluid (e.g., the working fluid 102, the primary cold stream 120, and/or the bypass stream 122). The refrigerant may flow through a heat exchanger (e.g., an evaporator) where the refrigerant absorbs heat from a fluid to be cooled and consequently evaporates into a vapor state. The vaporous refrigerant may then be cycled back to the compressor where the vapor compression refrigeration cycle continues. A vapor compression refrigerant cycle may include a variety of refrigerants. For example, embodiments of the present disclosure may utilize a refrigerant having propane, methane, butane, ethane, water, carbon dioxide, ammonia based compounds, Freon, R-11, R-12, R-410A, R-744, or any combination thereof.

Figure 6:
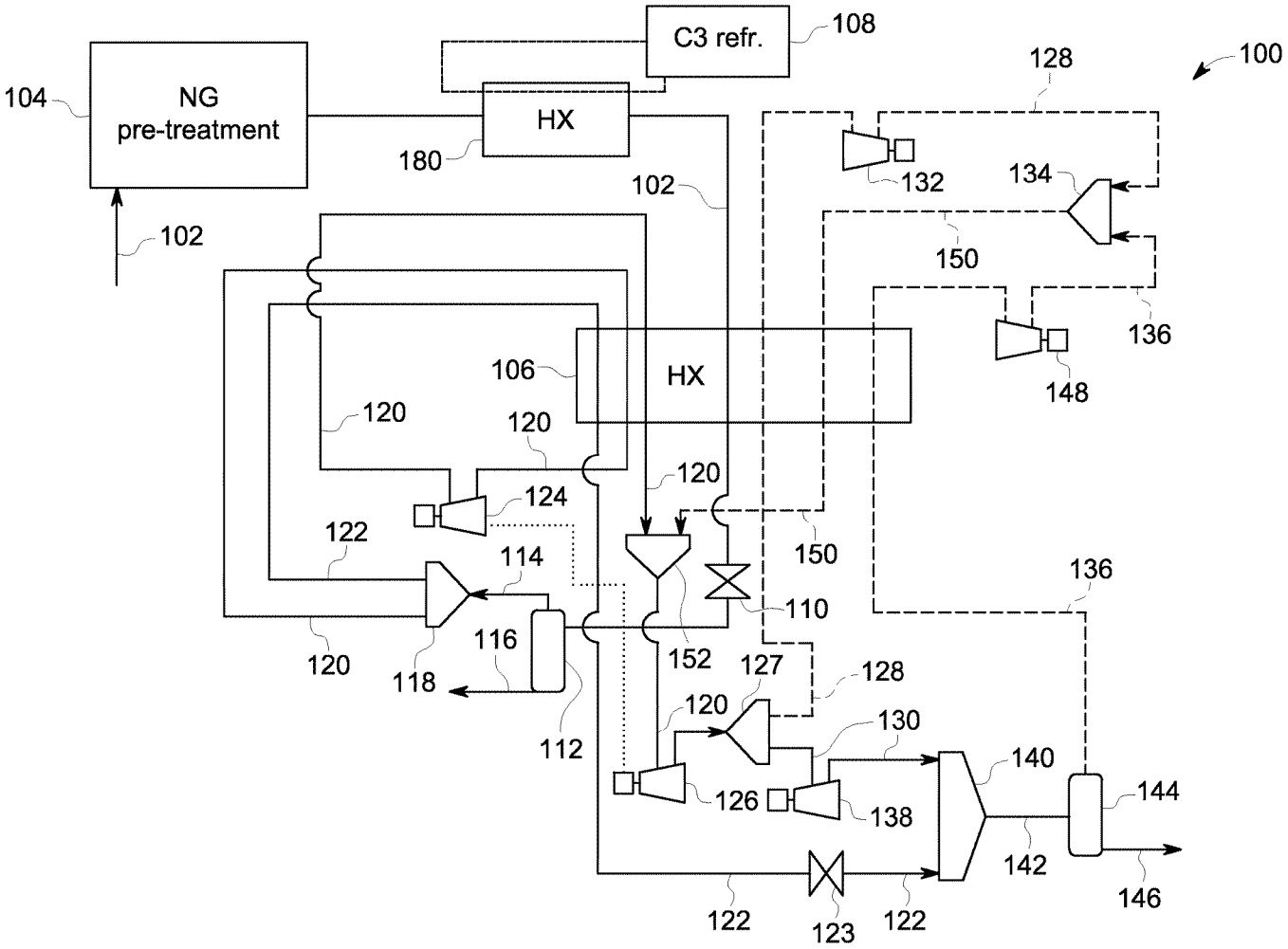
FIG. 6 is a process flow diagram of the gas liquefaction system of FIG. 5 having a second heat exchanger to pre-cool the working fluid, in accordance with an aspect of the present disclosure.

While the illustrated embodiment of FIG. 5 shows the vapor compression refrigeration cycle 108 flowing through the heat exchanger 106, in other embodiments, a second heat exchanger may be included in the process 100. For example, as illustrated in FIG. 6, a second heat exchanger 180 may be positioned upstream of the heat exchanger 106. The second heat exchanger 180 may utilize the vapor compression refrigeration cycle 108 to provide additional cooling to the process. Accordingly, the heat exchanger 106 may utilize the primary stream 120, the first recycle stream 128 and the second recycle stream 136 as coolant (e.g., not include a vapor compression refrigeration cycle). In other embodiments, the heat exchanger 106 may utilize the vapor compression refrigeration cycle 108 as a coolant, and the heat exchanger 180 may utilize a second vapor compression refrigeration cycle. In certain embodiments, the heat exchanger 180 may utilize any suitable refrigerant such as propane, methane, butane, ethane, water, carbon dioxide, ammonia based compounds, Freon, R-11, R-12, R-410A, R-744, or any combination thereof, to pre-cool the working fluid stream 102. It should be noted that the process 100 may include any suitable number of heat exchangers and vapor compression refrigeration cycles to maximize the efficiency of the process 100.

FIG. 7 is an illustration of another embodiment of process 100. In the illustrated embodiment of FIG. 7, the primary cold stream 120 may be compressed in the compressor 124 prior to entering the heat exchanger 106. Accordingly, one less stream of working fluid passes through the heat exchanger 106, which may enable a smaller, less expensive heat exchanger to be utilized. Additionally, the illustrated embodiment of FIG. 7 includes the heat exchanger 180. In addition to cooling the working fluid 102 using the vapor compression refrigeration cycle 108, the heat exchanger 180 may also be configured to cool the combined recycle stream 150.

Figure 8:
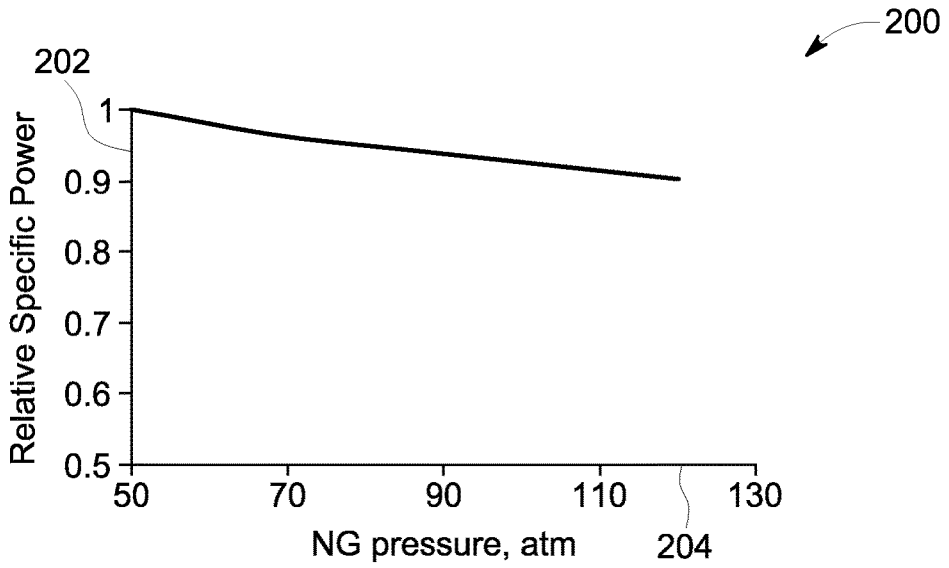
FIG. 8 is a graphical representation of relative efficiency of the gas liquefaction system of FIGS. 5, 6, and 7 as a function of pressure, in accordance with an aspect of the present disclosure.

The process 100 described in FIGS. 5, 6, and 7 may enable more efficient production of liquefied product (e.g., LNG). FIG. 8 is a graphical representation 200 of the relative efficiency 202 of a process in accordance with present embodiments as a function of pressure 204 of the working fluid supplied to the process. Although FIG. 8 shows the relative efficiency 202 of the process as it pertains to natural gas, it should be recognized that the process is not limited to the liquefaction of natural gas, but may be utilized to liquefy other substances as well (e.g., carbon dioxide). Additionally, FIG. 8 is meant to be representative of what can be achieved by the disclosed embodiments, and therefore, it is not meant to limit the presently disclosed embodiments to only such results.

FIG. 8 illustrates that as the pressure of the supplied working fluid increases the more efficient the process becomes. The efficiency 202 is measured in terms of specific power, or the power input to the system divided by the gallons of liquefied product (e.g., LNG) produced. Therefore, the smaller the quantity of specific power, the more efficient the process (e.g., less power generates more liquefied product). As can be seen in FIG. 8, as the pressure 204 of the supplied working fluid increases, the specific power decreases, meaning the process becomes more efficient. Therefore, the process operates most efficiently when the supplied working fluid is introduced to the process at a relatively high pressure. Again, the process increases in efficiency 202 as the pressure 204 of the supplied working fluid increases because the pressure drop in the turboexpanders may become greater, thereby generating more power and decreasing the temperature of the working fluid substantially.

Technical effects include a liquefaction process that includes one or more turboexpanders to generate a liquefied product with more efficiency than processes using only vapor compression refrigeration or other traditional cooling techniques.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A gas feed liquefaction system, comprising:

a flow path configured to convey a working fluid comprising a pressurized vapor in a downstream direction;

an initial cooling phase in a first heat exchange :relationship with the flow path, wherein the initial cooling phase comprises a heat exchanger;

a compressor positioned downstream of the initial cooling phase;

a second cooling phase in a second heat exchange relationship with the flow path, wherein the second cooling phase is downstream from the compressor and comprises a first turboexpander and a second turboexpander are arranged in a series configuration, wherein the first turboexpander is configured to simultaneously provide power to the compressor, cool the pressurized vapor, and condense at least a portion of the pressurized vapor into a liquid, and wherein the second turboexpander is configured to simultaneously provide power to an additional compressor, cool a remaining portion of the pressurized vapor into the liquid;

a separation vessel downstream of the second turboexpander and configured to separate a second portion of the remaining portion of the pressurized vapor from the liquid; and a recycle stream configured to direct the second portion of the remaining portion of the pressurized vapor through the heat exchanger toward a mixer, wherein the mixer is configured to combine the second portion of the remaining portion of the pressurized vapor with the flow path upstream of the second cooling phase.

2. The gas feed liquefaction system of claim 1, wherein one or both of the first turboexpander and the second turboexpander comprises between 7 and 15 stages.

3. The gas feed liquefaction system of claim 1, wherein the second cooling phase comprises a third turboexpander.

4. The gas feed liquefaction system of claim 1, wherein the heat exchanger is configured to transfer thermal energy from the flow path to a refrigerant of a vapor compression refrigeration cycle.

5. The gas feed liquefaction system of claim 1, comprising an additional separation vessel along the flow path upstream of the compressor and downstream of the initial cooling phase, wherein the additional separation vessel is configured to remove heavy hydrocarbons or contaminants from flow path.

6. The gas feed liquefaction system of claim 1, wherein a pressure ratio across at least one of the first turboexpander and the second turboexpander is between 1 and 5.

7. The gas feed liquefaction system of claim 1, wherein a pressure of the flow path upstream of the initial cooling phase is greater than 40 atmosphere.

8. The gas feed liquefaction system of claim 1, comprising a moisture removal device upstream of the initial cooling phase.

9. The gas feed liquefaction system of claim 1, comprising a third cooling phase upstream of the initial cooling phase, wherein the third cooling phase comprises a vapor compression refrigeration cycle.

10. The gas feed liquefaction system of claim 9, wherein the recycle stream is configured to pass through the third cooling phase before entering the mixer.

11. The gas feed liquefaction system of claim 1, wherein the first turboexpander is configured to separate the remaining portion of the pressurized vapor from the liquid and configured to direct the remaining portion of the pressurized vapor or the liquid to the second turboexpander.

12. A gas feed liquefaction system, comprising:

a flow path configured to convey a working fluid comprising a pressurized vapor in a downstream direction;

an initial cooling phase in a first heat exchange relationship with the flow path, wherein the initial cooling phase comprises a heat exchanger;

a compressor positioned downstream of the initial cooling phase;

a second cooling phase in a second heat exchange relationship with the flow path, wherein the second cooling phase is downstream from the compressor and comprises a first turboexpander and a second turboexpander are arranged in a series configuration, wherein the first turboexpander is configured to simultaneously provide power to the compressor, cool the pressurized vapor, and condense at least a portion of the pressurized vapor into a liquid, and the second turboexpander is configured to simultaneously provide power to an additional compressor, cool a remaining portion of the pressurized vapor, and condense at least a first portion of the remaining portion of the pressurized vapor into the liquid;

a splitter positioned downstream of the first turboexpander and upstream of the second turboexpander, wherein the splitter directs a first stream of the flow path through the heat exchanger and a second stream of the flow path to the second turboexpander, wherein the second stream comprises the remaining portion of the pressurized vapor;

a separation vessel downstream of the second turboexpander and configured to separate a second portion of the remaining portion of the pressurized vapor from the liquid; and a recycle stream configured to direct the second portion of the remaining portion of the pressurized vapor through the heat exchanger to a mixer, wherein the mixer is configured to combine one or more of the first stream, the second portion, and the flow path upstream of the second cooling phase.

13. The gas feed liquefaction system of claim 12, wherein one or both of the first turboexpander and the second turboexpander comprises between 7 and 15 stages.

14. The gas feed liquefaction system of claim 12, wherein the additional compressor is configured to compress the first stream and direct the first stream towards the mixer.

15. The gas feed liquefaction system of claim 12, wherein a pressure ratio across at least one of the first turboexpander and the second turboexpander is between 1 and 5.

* * * * *